United States Patent [19]

Isokawa et al.

[11] Patent Number: 4,584,032

[45] Date of Patent: Apr. 22, 1986

[54] BOLTING BAR MATERIAL AND A METHOD OF PRODUCING THE SAME

[75] Inventors: Kenji Isokawa; Kunio Namiki, both of Nagoya; Kenji Takahashi, Chita, all of Japan

[73] Assignee: Daido Steel Company Limited, Nagoya, Japan

[21] Appl. No.: 559,535

[22] Filed: Dec. 8, 1983

[30] Foreign Application Priority Data

Dec. 10, 1982 [JP] Japan ..... 57-215548

[51] Int. Cl.[4] ..... C21D 7/14

[52] U.S. Cl. ..... 148/12 B

[58] Field of Search ..... 75/123 J; 148/12 B, 148/12 R

[56] References Cited

U.S. PATENT DOCUMENTS 3,666,570 5/1972 Korchynsky et al. ..... 75/123 J 3,671,334 6/1972 Bucher et al. ..... 75/123 J 3,926,687 12/1975 Gondo et al. ..... 148/12 B

*Primary Examiner*—Wayland Stallard

*Attorney, Agent, or Firm*—Sughrue, Mion, Zinn, Macpeak, and Seas

[57] ABSTRACT

A bolting bar material consists in weight ratio of 0.05~0.2% of C, 0.05~0.8% of Si, 0.8~2% of Mn, not more than 0.035% of P, not more than 0.030% of S, 0.005~0.05% of Nb, 0.01~0.05% of Al, 0.005~0.025% of N, 0.05~0.35% in total of at least one element selected from not more than 0.25% of V, not more than 0.25% of Ti and not more than 0.25% of Zr, and if necessary, 0.05~1.5% in total of at least one element selected from 0.05~0.5% of Ni, 0.05~0.5% of Cr and 0.05~0.5% of Mo, and the balance of Fe. In the production of the bolting bar material, the steel having the above composition is heated to 1000°~1100° C., rolled at a finish rolling temperature of 750°~950° C. and cooled at a rate of 5°~50° C./sec on average.

2 Claims, 2 Drawing Figures

BOLTING BAR MATERIAL AND A METHOD OF PRODUCING THE SAME

BACKGROUND OF THE INVENTION

1. Field of the Invention

This invention relates to bolting bar materials suitable for the manufacture of bolts having an excellent toughness of 7T grade (70~80 kgf/mm$^2$) to 8T grade (80~90 kgf/mm$^2$) and a method of producting the same.

2. Description of the Prior Art

Heretofore, bolts used for assembling mechanical parts are usually manufactured by cold molding a bolting material and subjecting it to a heat treatment so as to provide a required strength, which is performed, for example, according to a flow sheet as shown in FIG. 1.

In the above conventional process, however, the secondary working step is lengthened, so that the manufacture of the bolt takes a long time and the production cost becomes increased.

In order to solve the above drawbacks, there have been developed so-called non-heat treated steels, which allow to omit heat treatments such as annealing, quenching. tempering and the like. Among them, some steels have been attempted to use as a material for the manufacture of 7T-8T grade bolts, but have not yet been put into practical use. Because, the bolt made from such a non-heat treated steel is low in the toughness. That is, the non-heat treated steel certainly has a tensile strength of 70~90 kgf/mm$^2$ as it is rolled, but the bolt made therefrom frequently causes the fracture at the junction of head, for example, when it is subjected to a wedge tensile test as an actual test.

SUMMARY OF THE INVENTION

It is, therefore, an object of the invention to solve the aforementioned drawbacks of the prior arts. That is, the invention provides a bolting bar material which can be produced without being subjected to a heat treatment such as quenching, tempering or the like by optionally balancing various alloying elements and can manufacture bolts having no fracturing at head junction in the wedge tensile test and a toughness equal to that of the bolt made from the conventional steel for mechanical structure by quenching and tempering.

DETAILED DESCRIPTION OF THE INVENTION

Figure 1:
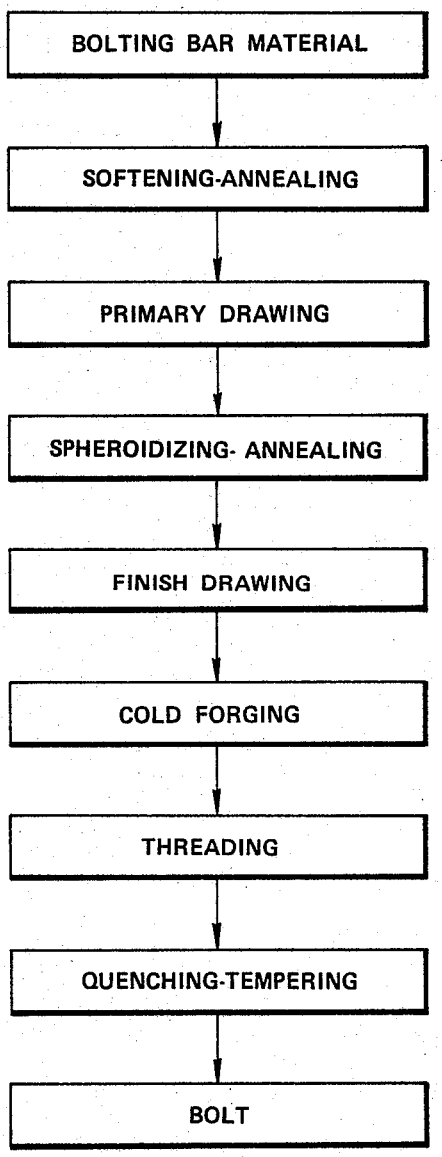
FIG. 1 is a flow sheet illustrating the conventional production steps for the manufacture of bolts by quenching, tempering as mentioned above.

The bolting bar material according to the invention consists of 0.05~0.2% by weight of carbon, 0.05~0.8% by weight of silicon, 0.8~2% of manganese, not more than 0.035% by weight of phosphorus, not more than 0.030% by weight of sulfur, 0.005~0.05% by weight of niobium, 0.01~0.05% by weight of aluminum, 0.005~0.025% by weight of nitrogen, 0.05~0.35% by weight in total of at least one element selected from not more than 0.25% of vanadium, not more than 0.25% of titanium and not more than 0.25% of zirconium, and if necessary, 0.05~1.5% by weight in total of at least one element selected from 0.05~0.5% of nickel, 0.05~0.5% of chromium and 0.05~0.5% of molybdenum, and the balance of iron.

The bolting bar material is produced by rolling of steel slab and then shaped into bolts, which are ready for use without a post heat treatment (quenching, tempering). The reason why the ingredients for the bolting bar material are limited to the above defined ranges (% by weight) is as follows.

C: 0.05~0.2%

In order to ensure the desired strength of the bolt, it is necessary to contain not less than 0.05% of carbon. However, when the C content is too large, the cold headability lowers and the toughness degrades, so that it is necessary to be not more than 0.2%.

Si: 0.05~0.8%

Silicon is a deoxidizing element required in the production of molten steel and plays a roll as solid-solute to strengthen ferrite matrix, so that it is added in an amount of not less than 0.05%. However, when the Si content is too large, the processability lowers and the cold headability degrades, so that the upper limit is 0.8%.

Mn: 0.8~2%

Manganese is an element having deoxidation and desulfurization actions and also serves to improve the hardenability and further to finely divide the matrix for improving the toughness. In order to obtain such effects, it is necessary to be added in an amount of not less than 0.8%. However, when the Mn content exceeds 2%, the above effects are saturated, while the segregation degree of Mn is increased to degrade the toughness, so that the upper limit should be 2%.

P: not more than 0.035%

Phosphorus is a segregatable element. When the P content is too large, the impact value lowers, so that it should be not more than 0.035%.

S: not more than 0.030%

Sulfur is a segregatable element. When the S content is too large, the cold headability lowers and also the toughness degrades, so that it should be not more than 0.030%. Further, by reducing the S content, the amount of MnS inclusion may be decreased to enhance the toughness, so that the S content of not more than 0.01% is more desirable.

Nb: 0.005~0.05%

Al: 0.01~0.05%

N: 0.005~0.025%

Niobium, aluminum and nitrogen are primary elements in the bolting bar material according to the invention and can provide synergetic effect within the above defined ranges whereby the grain fining after the rolling can be accomplished to provide a good toughness even at a non-heat treated state. Particularly, when N is added in an amount of 0.005~0.025%, even if the Nb content is very slight, the grain fining can be achieved to obtain a non-heat treated bolting steel having an excellent toughness.

V, Ti, Zr: 0.05~0.35% in total of at least one element of not more than 0.25% of V, not more than 0.25% of Ti and not more than 0.25% of Zr Each of vanadium, titanium and zirconium is an element forming a carbonitride and has an effect that they finely precipitate during the rolling to suppress the recrystallization and also perlite.ferrite structure is finely divided to enhance the strength by precipitation hardening. In order to obtain such an effect, at least one of V, Ti and Zr is necessary to be added in an amount of not less than 0.05% in total. On the other hand, the effect is saturated when adding each of these elements alone in an amount of more than 0.25% or when adding combination of these elements in an amount of more than 0.35%.

Ni, Cr, Mo: 0.05~1.5% in total of at least one of 0.05~0.5% of Ni, 0.05~0.5% of Cr and 0.05~0.5% of Mo Each of nickel, chromium and molybdenum is an element added for improving the hardenability and increasing the strength. For this purpose, they are necessary to be added in an amount of 0.05% at minimum in total. However, considering the diameter of the bolt for 7T and 8T grades, the hardenability is sufficiently achieved when adding each of these elements alone in an amount of 0.5% at maximum or when adding combination of them in an amount of not more than 1.5% in total.

In the production of non-heat treated type bolting bar materials having the ingredient ranges as described above, a steel slab satisfying these ingredient ranges is rolled into a product and then cooled, during which carbonitrides of Nb, V, Ti, Zr and the like are precipitated to increase the strength. For this purpose, it is necessary to solute these precipitates at the heating step prior to the product-rolling. In the usual case, the heating is carried out at a temperature of not less than 1150° C. prior to the product-rolling.

For this end, the initial crystal grains prior to the product-rolling may be coarsened by the heating as described above. Therefore, the inventors have made studies on the fining of the initial crystal grain or the possibility of lowering the heating temperature and minutely examined the solution temperature, and as a result it has been found that the solution temperature of vanadium carbonitride is the lowest. That is, it has been confirmed that the coarsening of the initial crystal grains due to the heating prior to the product-rolling can sufficiently be prevented by selecting V as a precipitation-hardening element, whereby the solid solution treatment can satisfactorily be performed when the heating temperature is not less than 1000° C. As a result, the same object as described on the bolting bar material can be achieved and the mechanical properties of this material can be more improved.

According to another aspect of the invention, there is provided a method of producing a bolting bar material, characterized in that a steel material consisting of 0.05~0.2% by weight of carbon, 0.05~0.8% by weight of silicon, 0.8~2% of manganese, not more than 0.035% by weight of phosphorus, not more than 0.030% by weight of sulfur, 0.005~0.05% by weight of niobium, 0.01~0.05% by weight of aluminum, 0.005~0.025% by weight of nitrogen, not more than 0.25% by weight of vanadium, and if necessary, 0.05~1.5% by weight in total of at least one element selected from 0.05~0.5% by weight of nickel, 0.05~0.5% by weight of chromium and 0.05~0.5% by weight of molybdenum and the balance of iron is heated to 1000°~1100° C. and then rolled at a finish rolling temperature of 750°~950° C. and cooled at an average cooling rate of 5°~50° C./sec during the product-rolling.

In this production method, the reason why each of the elements is limited to the given range is the same as previously mentioned, while the reason for the limitation of the production conditions is as follows.

Heating temperature prior to production-rolling: 1000°~1100° C.

Since V is contained in the steel as an element forming a carbonitride, it is possible to sufficiently solute the carbonitride of V even when the heating temperature is lower than the conventionally used one as mentioned above, so that the heating temperature is sufficient to be not less than 1000° C. On the other hand, when the heating temperature is too high, there is caused a posibility of coarsening the initial crystal grains before the rolling, so that the upper limit is 1100° C.

Finish rolling temperature: 750°~950° C.

The invention is characterized by performing the rolling operation at an unrecrystallization region. In order to finely divide the finally obtained ferrite+pearlite structure, therefore, the finish rolling temperature is necessary to be within a range of 750°~950° C.

Average cooling rate: 5°~50° C./sec

The cooling conditions in the course of rolling end→winding→collecting govern the densification degree of ferrite+pearlite structure and the mount of carbonitride precipitaions. Therefore, in order to obtain the toughness of 7~8T grade, the cooling rate is suitable to be 5°~50° C./sec on average. That is, when the cooling rate is less than 5° C./sec, the sufficient toughness is not obtained, while when the cooling rate exceeds 50° C./sec, the above structure is changed into a bainite structure and the toughness excessively decreases.

The invention will be explained with respect to the following example.

The following Table 1 shows chemical compositions of steel materials to be used in this example, wherein the steel kinds A–H correspond to first steel materials according to the invention, the steel kinds I–L correspond to second steel materials according to the invention, and the steel kinds M and N correspond to comparative steel materials. Among them, the steel kind M is the conventional non-heat treated steel and the steel kind N is the conventional bolting steel (corresponding to JIS S45C steel which is equivalent to SAE 1045) to be used after the quenching.tempering.

TABLE 1

| Kind of steel | | C | Si | Mn | P | S | Ni | Cr | Mo | Nb | V | Ti | Zr | Al | N |
|---|---|---|---|---|---|---|---|---|---|---|---|---|---|---|---|
| Invention steel | A | 0.15 | 0.33 | 1.51 | 0.020 | 0.020 | — | — | — | 0.020 | 0.14 | — | — | 0.032 | 0.013 |
| " | B | 0.08 | 0.12 | 1.33 | 0.018 | 0.012 | — | — | — | 0.006 | 0.09 | — | — | 0.012 | 0.006 |
| " | C | 0.10 | 0.71 | 1.31 | 0.018 | 0.008 | — | — | — | 0.016 | — | 0.18 | — | 0.024 | 0.010 |
| " | D | 0.16 | 0.55 | 1.72 | 0.015 | 0.004 | — | — | — | 0.043 | — | — | 0.22 | 0.020 | 0.010 |
| " | E | 0.10 | 0.61 | 0.89 | 0.020 | 0.015 | — | — | — | 0.034 | 0.07 | 0.07 | — | 0.040 | 0.021 |
| " | F | 0.15 | 0.12 | 0.87 | 0.021 | 0.017 | — | — | — | 0.037 | — | 0.09 | 0.08 | 0.016 | 0.007 |
| " | G | 0.12 | 0.23 | 1.68 | 0.020 | 0.018 | — | — | — | 0.021 | 0.09 | — | 0.13 | 0.040 | 0.015 |
| " | H | 0.14 | 0.18 | 1.35 | 0.022 | 0.010 | — | — | — | 0.021 | 0.07 | 0.06 | 0.08 | 0.025 | 0.012 |
| " | I | 0.14 | 0.31 | 1.83 | 0.014 | 0.009 | — | — | 0.38 | 0.026 | 0.10 | — | — | 0.018 | 0.013 |
| " | J | 0.10 | 0.23 | 1.65 | 0.016 | 0.010 | 0.37 | 0.21 | — | 0.019 | — | 0.09 | 0.15 | 0.022 | 0.018 |
| " | K | 0.13 | 0.29 | 1.72 | 0.018 | 0.013 | — | 0.41 | — | 0.028 | 0.09 | 0.13 | — | 0.031 | 0.020 |
| " | L | 0.15 | 0.32 | 1.77 | 0.020 | 0.010 | 0.28 | — | 0.25 | 0.009 | 0.13 | — | — | 0.015 | 0.022 |
| Comparative steel | M | 0.08 | 0.23 | 1.50 | 0.018 | 0.013 | — | — | — | — | 0.11 | — | — | 0.021 | 0.003 |

TABLE 1-continued

| Kind of steel | | C | Si | Mn | P | S | Ni | Cr | Mo | Nb | V | Ti | Zr | Al | N |
|---|---|---|---|---|---|---|---|---|---|---|---|---|---|---|---|
| " | N | 0.46 | 0.24 | 0.71 | 0.022 | 0.024 | — | — | — | — | — | — | — | 0.023 | 0.005 |

At first, the steel material for each of the steel kinds A–H and M, N was melted and cast into a steel slab of 146 mm square, which was rolled into a bar material of 9.0 mm diameter under the rolling conditions as shown in the following Table 2 (Run Nos. 2, 5 and 6 correspond to the first conditions defined by the invention). The thus obtained bar material was further subjected to a cold drawing to thereby obtain a bolting bar material of 7.8 mm diameter, which was cold headed into a hexagon headed bolt of M8×80 mm(l), subjected to threading and finally subjected to a blueing treatment. Moreover, the bolt produced from the steel kind N was subjected to quenching.tempering treatment in the usual manner.

On the other hand, the steel material for each of the steel kinds I–L was melted and cast into a steel slab of 146 mm square, which was rolled into a bar material of 15.0 mm diameter under the rolling conditions shown in Table 2 (Run Nos. 15 and 19 correspond to the second conditions defined by the invention). Then, the bar material was subjected to a cold drawing to thereby obtain a bolting bar material of 11.8 mm diameter, which was cold headed into a slightly large diameter hexagon headed bolt of M12×100 mm(l), subjected to a threading and finally subjected to blueing treatment.

In the production of such bolts, the grain size and tensile properties were measured with respect to the bolting bar materials of 7.8 mm and 11.8 mm diameters to obtain results as shown in the following Table 3. The measurement of grain size was carried out according to a method of JIS G 0551, while the tensile test was made by using a test piece No. 14A prescribed in JIS Z 2201.

TABLE 2

| Kind of steel | Run No. | Heating Temperature (°C.) | Finish temperature (°C.) | Cooling rate (°C./sec) |
|---|---|---|---|---|
| A | 1 | 1200 | 895 | 20 |
| " | 2 | 1100 | 820 | 20 |
| " | 3 | 1100 | 1000 | 30 |
| B | 4 | 1200 | 900 | 30 |
| " | 5 | 1100 | 885 | 20 |
| " | 6 | 1050 | 850 | 20 |
| " | 7 | 1100 | 885 | 3 |
| C | 8 | 1200 | 940 | 20 |
| D | 9 | 1180 | 900 | 20 |
| E | 10 | 1200 | 900 | 20 |
| F | 11 | 1200 | 900 | 20 |
| G | 12 | 1200 | 900 | 20 |
| H | 13 | 1200 | 900 | 20 |
| I | 14 | 1200 | 890 | 10 |
| " | 15 | 1100 | 820 | 10 |
| J | 16 | 1200 | 1000 | 5 |
| K | 17 | 1200 | 860 | 15 |
| L | 18 | 1200 | 1000 | 15 |
| " | 19 | 1100 | 850 | 15 |
| M | 20 | 1200 | 900 | 20 |
| N | 21 | 1200 | 900 | 1 |

TABLE 3

| Kind of steel | Run No. | Grain size | Tensile strength (kgf/mm²) | Yield strength (0.2% offset) (kgf/mm²) | Elongation (%) | Reduction of area (%) |
|---|---|---|---|---|---|---|
| A | 1 | 11.0 | 83.8 | 71.2 | 16.5 | 71.1 |

TABLE 3-continued

| Kind of steel | Run No. | Grain size | Tensile strength (kgf/mm²) | Yield strength (0.2% offset) (kgf/mm²) | Elongation (%) | Reduction of area (%) |
|---|---|---|---|---|---|---|
| " | 2 | 12.3 | 84.5 | 72.9 | 17.3 | 75.4 |
| " | 3 | 10.4 | 83.0 | 72.1 | 15.8 | 70.6 |
| B | 4 | 10.8 | 83.7 | 71.0 | 16.4 | 72.3 |
| " | 5 | 12.0 | 84.6 | 71.9 | 17.5 | 74.7 |
| " | 6 | 12.5 | 84.3 | 71.7 | 17.8 | 75.0 |
| " | 7 | 11.0 | 80.1 | 70.6 | 16.7 | 71.2 |
| C | 8 | 11.3 | 84.3 | 71.5 | 16.4 | 70.8 |
| D | 9 | 11.0 | 83.6 | 71.0 | 16.5 | 70.5 |
| E | 10 | 10.8 | 84.4 | 72.0 | 15.8 | 72.1 |
| F | 11 | 11.2 | 83.5 | 71.1 | 16.0 | 71.7 |
| G | 12 | 11.3 | 84.0 | 71.8 | 16.3 | 70.6 |
| H | 13 | 11.3 | 83.9 | 72.4 | 16.5 | 71.3 |
| I | 14 | 11.3 | 85.2 | 74.8 | 16.1 | 71.6 |
| " | 15 | 12.4 | 85.8 | 74.8 | 17.5 | 74.5 |
| J | 16 | 10.9 | 85.1 | 75.3 | 16.2 | 70.1 |
| K | 17 | 11.2 | 85.3 | 74.5 | 16.0 | 72.0 |
| L | 18 | 11.5 | 85.0 | 74.8 | 16.3 | 70.4 |
| " | 19 | 12.1 | 86.7 | 76.5 | 17.4 | 72.5 |
| M | 20 | 8.8 | 83.5 | 70.7 | 10.6 | 65.9 |
| N | 21 | 8.3 | 83.8 | 71.2 | 16.4 | 70.4 |

As apparent from Table 3, in all of the steels A–H and I–L according to the invention, the crystal grain is finer than that of the comparative steels M and N, and the elongation and reduction of area are fairly enhanced as compared with those of the conventional non-thermal refining steel, and the toughness is substantially equal to that of the conventional quenched and tempered steel. Furthermore, even when the diameter of the bolting bar material according to the invention is large, the improved properties are obtained by adding Ni, Cr and Mo. Particularly, in the steels produced under the rolling conditions of Run Nos. 2, 5, 6, 15 and 19 according to the invention, the crystal grain is made finer and the strength becomes higher and the elongation and reduction of area are further improved.

Figure 2:
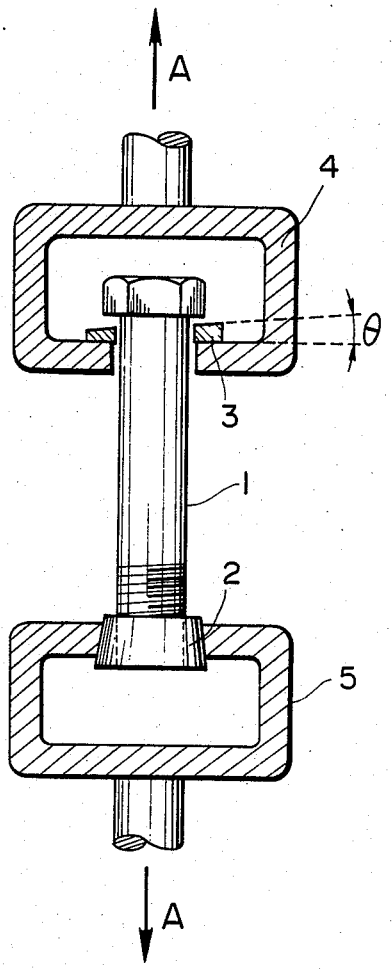
FIG. 2 is a schematic view of a wedge tensile test.

Then, the actual strength of each bolt obtained by the production method as mentioned above was measured by a wedge tensile tester as shown in FIG. 2, wherein numeral 1 is a hexagon headed bolt to be tested, numeral 2 is trapezoidal nut, numeral 3 is an annular wedge having a wedge angle $\theta$ of 15°, numeral 4 is a supporting member for the wedge, and numeral 6 is a supporting member for the nut. In this test, the wedge tensile strength and the fractured position were measured by applying a tensile force in an arrow direction A to the bolt. Moreover, a radius at the junction of head in the hexagon headed bolt 1 was 0.1R. The thus obtained results are shown in the following Table 4.

TABLE 4

| Kind of steel | Run No. | Wedge tensile strength (kgf/mm²) | Breaking position |
|---|---|---|---|
| A | 1 | 82.6 | threaded portion |
| " | 2 | 84.0 | " |
| " | 3 | 82.5 | " |
| B | 4 | 83.7 | " |
| " | 5 | 83.5 | " |
| " | 6 | 84.1 | " |
| " | 7 | 80.0 | " |
| C | 8 | 82.7 | " |
| D | 9 | 83.1 | " |
| E | 10 | 83.5 | " |

TABLE 4-continued

| Kind of steel | Run No. | Wedge tensile strength (kgf/mm$^2$) | Breaking position |
|---|---|---|---|
| F | 11 | 83.8 | " |
| G | 12 | 83.6 | " |
| H | 13 | 83.1 | " |
| I | 14 | 84.8 | " |
| " | 15 | 84.7 | " |
| J | 16 | 83.5 | " |
| K | 17 | 84.2 | " |
| L | 18 | 84.6 | " |
| " | 19 | 85.7 | " |
| M | 20 | 58.4 | junction of head |
| N | 21 | 82.3 | threaded portion |

As apparent from Table 4, all of the bolts produced from the steels A–H and I–L according to the invention have a high wedge tensile strength, which is equal to or more than that of the conventional quenched tempered steel, and their fractured position is the threaded portion, from which it is obvious that the bolts according to the invention can be produced in a low cost. On the other hand, in the conventional non-heat treated steel bolt, the wedge tensile strength is low and the breaking position is the junction of head, so that the bolt is very susceptible to cracks.

In addition, it has been confirmed that the bolts produced from the bolting bar material according to the invention have good properties equal to those of the conventional quenched.tempered steel even when being subjected to the other tests required for the bolt such as proof loading test, fatigue test and the like.

As mentioned above, the bolting bar material having a considerably good balance between the alloying elements can be obtained according to the invention. When such a bolting bar material is used to produce bolts without being subjected to a heat treatment such as quenching, tempering and the like, the mechanical strength and thoughness of the resulting bolt are equal to or more than those of the conventional quenched.-tempered steel bolt and are fairly better than those of bolt produced from the conventional non-heat treated steel and also there is no fear of causing the breaking of the bolt at its junction of head as in the conventional non-thermal refining steel bolt. That is, according to the invention, bolts of 7T–8T grades can be produced in a high productivity and in a low cast. Particularly, the heating temperature prior to the product rolling can be lowered by using V as a carbonitride forming element according to the invention, whereby the mechanical properties of the resulting bolt can be more improved.

What is claimed is:

1. A method of producing a bolting bar material, characterized in that a steel material consisting of 0.05~0.2% by weight of carbon, 0.05~0.8% by weight of silicon, 0.8~2% by weight of manganese, not more than 0.035% by weight of phosphorus, not more than 0.030% by weight of sulfur, 0.005~0.05% by weight of niobium, 0.01~0.05% by weight of aluminum, 0.005~0.025% by weight of nitrogen, 0.05~0.25% by weight of vanadium and the balance of iron is heated to 1000°~1100° C. and then rolled at a finish rolling temperature of 750°~950° C. and cooled at an average cooling rate of 5°~50° C./sec during the product-rolling.

2. A method of producing a bolting bar material, characterized in that a steel material consisting of 0.05~0.2% by weight of carbon, 0.05~0.8% by weight of silicon, 0.8~2% by weight of manganese, not more than 0.035% by weight of phosphorus, not more than 0.030% by weight of sulfur, 0.005~0.05% by weight of niobium, 0.01~0.05% by weight of aluminum, 0.005~0.025% by weight of nitrogen, 0.05~0.25% by weight of vanadium, 0.05~1.5% by weight in total of at least one element selected from 0.05~0.5% of nickel, 0.05~0.5% of chromium and 0.05~0.5% of molybdenum and the balance of iron is heated to 1000°~1100° C. and then rolled at finish rolling temperature of 750°~950° C. and cooled at an average cooling rate of 5°~50° C./sec during the product-rolling.

* * * * *